US005114540A

United States Patent [19]

Law

[11] Patent Number: 5,114,540

[45] Date of Patent: May 19, 1992

[54] APPARATUS FOR CHEMICAL TREATMENT OF LIGNOCELLULOSIC MATERIALS

[75] Inventor: Kwei-Nam Law, 3705 Boulevard des Chenaux, Trois-Rivieres, Quebec, Canada, G8Y 1A5

[73] Assignees: Kwei-Nam Law; Jacques L. Valade, both of Québec, Canada

[21] Appl. No.: 402,629

[22] Filed: Sep. 5, 1989

[51] Int. Cl.[5] ..... D21C 7/10; D21C 7/14

[52] U.S. Cl. ..... 162/247; 162/249; 162/250; 162/233; 422/285; 422/289; 422/290; 422/307

[58] Field of Search ..... 162/233, 241, 242, 243, 162/247, 249, 250, 41, 46; 422/285, 289, 290, 307, 308

[56] References Cited

U.S. PATENT DOCUMENTS

| | | | |
|---|---|---|---|
| 1,198,990 | 9/1916 | Bashlin | 162/249 |
| 1,905,731 | 4/1933 | McKee | 162/249 |
| 3,035,962 | 5/1962 | Schinn | 162/250 |
| 3,347,741 | 10/1967 | Hutchison | 162/241 |
| 3,397,110 | 8/1968 | Rosenblad | 162/249 |
| 3,881,986 | 5/1975 | Bachlund | 162/41 |

*Primary Examiner*—Richard V. Fisher
*Assistant Examiner*—Todd J. Burns

[57] ABSTRACT

An apparatus for chemical treatment of lignocellulosic materials comprises two concentric compartments, the inner one is used for chemical reaction whereas the outer is used for generation of hot water or steam. The top and the bottom of the outer compartment is closed and connected to the inner one. These two are interconnected by two steam conduits. The inner compartment is also connected to a circulation pump and a heat exchanger. The bottom of the this inner compartment is equipped with a quick-release valve which may be used to execute explosive discharge of the treated lignocellulosic material. On top of said apparatus is a cover which allows experiments to be performed under pressurized conditions. For experimentation, lignocellulosic material in form of chips (large particles) may be treated either with heated chemical solution or steam. Materials in form of fibers (fine particles) may be treated by means of vapor or by heat conduction furnished by the outer compartment. Chemical treatment such as impregnation of lignocellulosic materials with chemicals under vacuum or under pressurized conditions, liquid phase or vapor phase cooking of preimpregnated lignocellulosic materials, and explosion pulping of lignocellulosic materials, etc. The temperatures for chemical treatment of lignocellulosic materials can be up to 250° C.

7 Claims, 2 Drawing Sheets

APPARATUS FOR CHEMICAL TREATMENT OF LIGNOCELLULOSIC MATERIALS

BACKGROUND OF THE INVENTION

Figure 1:
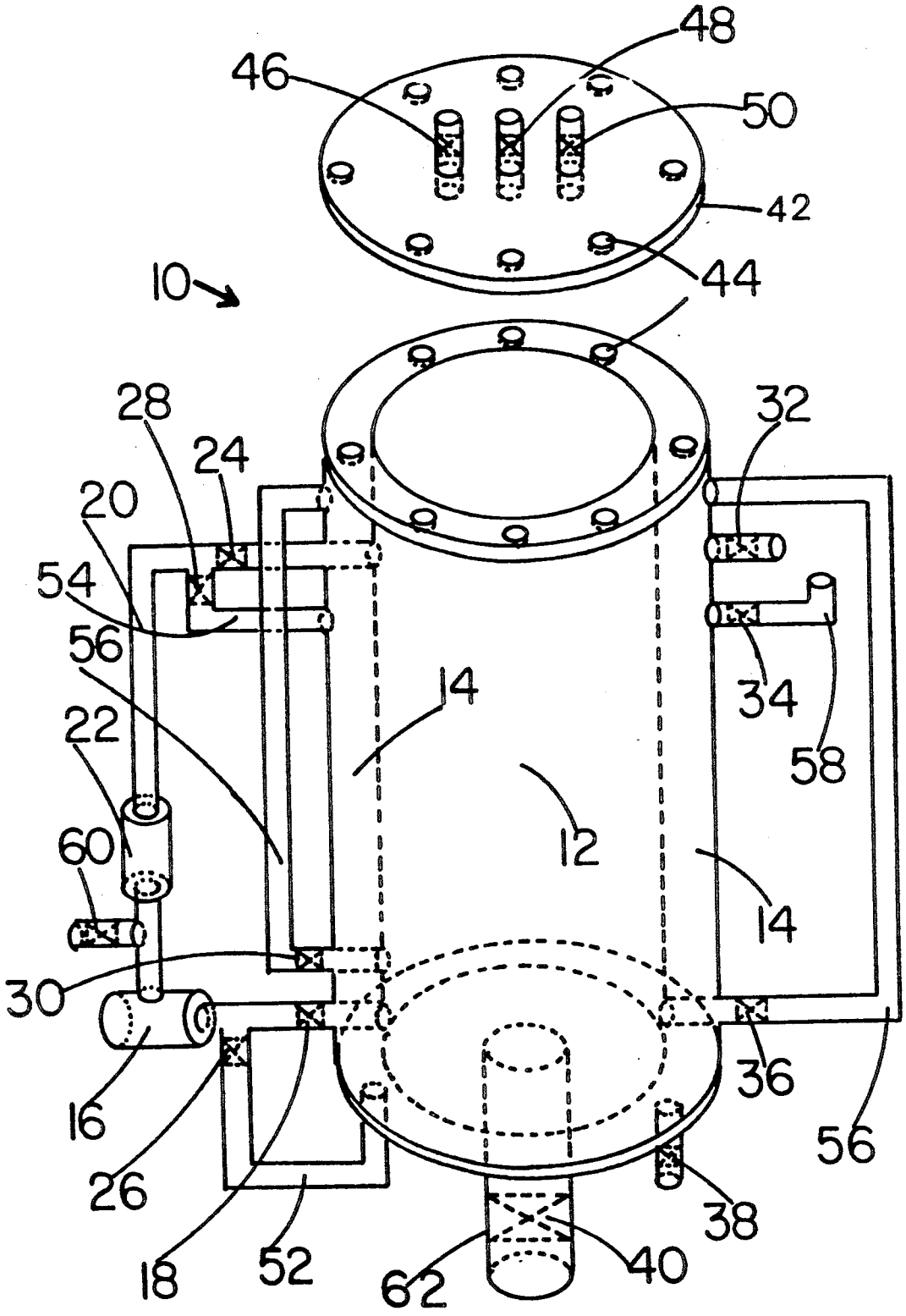

The present invention relates to an apparatus for chemical treatment of lignocellulosic materials.

Various types of such apparatus, such as the Mini-Mill Laboratory Digester manufactured by M/K Systems Inc. (Danvers, Mass., U.S.A.) and the Micro-Pro Laboratory Digester manufactured by Aurora Technical Products Ltd. (Vancouver, British Columbia, Canada) are known. These types of apparatus have disadvantages of being standard single-compartment digester which permits liquid phase cooking. They are not designed for executing the following treatments: steam phase cooking, inter-stage sulfonation of mechanical pulps, bleaching of pulps, explosion pulping, vacuum impregnation, pressure impregnation, presteaming of raw materials, treatment of materials in fiberous form.

Quantum Technologies, Inc. (Twinsburg, Ohio, U.S.A.) has introduced a Quantum High Intensity Laboratory Mixer/Reactor which is designed for pulp mixing and bleaching. The maximum working temperature of this mixer/reactor is 110° C., which is not adequate for most chemical treatments of lignocellulosic materials.

It is desirable to have an apparatus for chemical treatment of lignocellulosic materials, which is made of two concentric compartments, one for digestion and the other for steam or heat generation, can be used to do various types of chemical treatment experiments. The present invention relates to an apparatus which has multiple functions in chemical treatment of lignocellulosic materials.

GENERAL DESCRIPTION OF THE INVENTION

The present invention relates to an apparatus for chemical treatment of lignocellulosic materials. In one aspect of the invention, the apparatus comprises two concentric compartments, the inner one is used for holding the material to be treated and the outer one is used for generating heat or steam. These two compartments are interconnected by two steam conduits, one opposite to the other, which allow the steam generated in the outer compartment to pass to the inner compartment through two valves located near the bottom of the apparatus. The inlet of the steam conduit is located on the upper part of the outer compartment, and is higher than the water inlet of the same compartment. The outer compartment supplies heat to the inner one by means of its water which is circulated by a pump and heated by a heat exchanger. The inner compartment is also connected to the circulation pump and the heat exchanger for the purpose of liquid phase chemical treatment. In another aspect of this apparatus, the circulation pump, located outside and near the bottom of the apparatus, is connected, at one end, by means of a conduit, to the lower part, near the bottom of the inner compartment. At the other end, the pump is connected through a conduit leading to a heat exchanger whose position should be as low as possible in relation to the inner compartment. The upper end of the heat exchanger is connected by means of a conduit, to the upper part of the inner compartment. The lower and the upper ends of the circulation conduit are also connected to the outer compartment by means of two valves, in such a way that the water in the outer compartment can be circulated by the pump and heated by the heat exchanger. The heat exchanger can heat water, steam or treatment liquor up to a temperature of 250° C.

Furthermore, a sample valve is located on the circulation conduit, between the pump and the heat exchanger. This sample value allows sample collecting of the treatment liquor during the process.

With further regard to the outer compartment, a water inlet is located on the upper part of its external wall, which is used for filling this compartment with water. A valve located near the inlet is used for preventing the steam or heated water from flowing out. The water inlet is located at a position lower than the inlet of the steam conduit leading to the inner compartment. A breath valve located above the water inlet is used for letting the air out from the outer compartment when this compartment is being filled.

In another aspect of the invention, the apparatus comprises a cover so that chemical treatments can be performed under pressurized conditions. The cover is fixed onto to the main body of the apparatus by means of nuts and bolts. An O-ring made of viton is placed between the cover and the main body of the apparatus to keep it pressure-tight. The cover comprises three valves: a pressure release valve, a cold water-spray valve for quick cooling, and a pressure relief valve or safty valve.

In a further embodiment of the invention, the apparatus comprises a quick-release discharge valve located at its bottom for easy discharge or for explosive discharge into a blow tank where the treated material is collected. All the main parts of the apparatus are made of stainless steel for the sake of safty and anti-corrosion.

The outside of the apparatus is to be insulated.

SPECIFIC DESCRIPTION OF THE INVENTION

Figure 2:
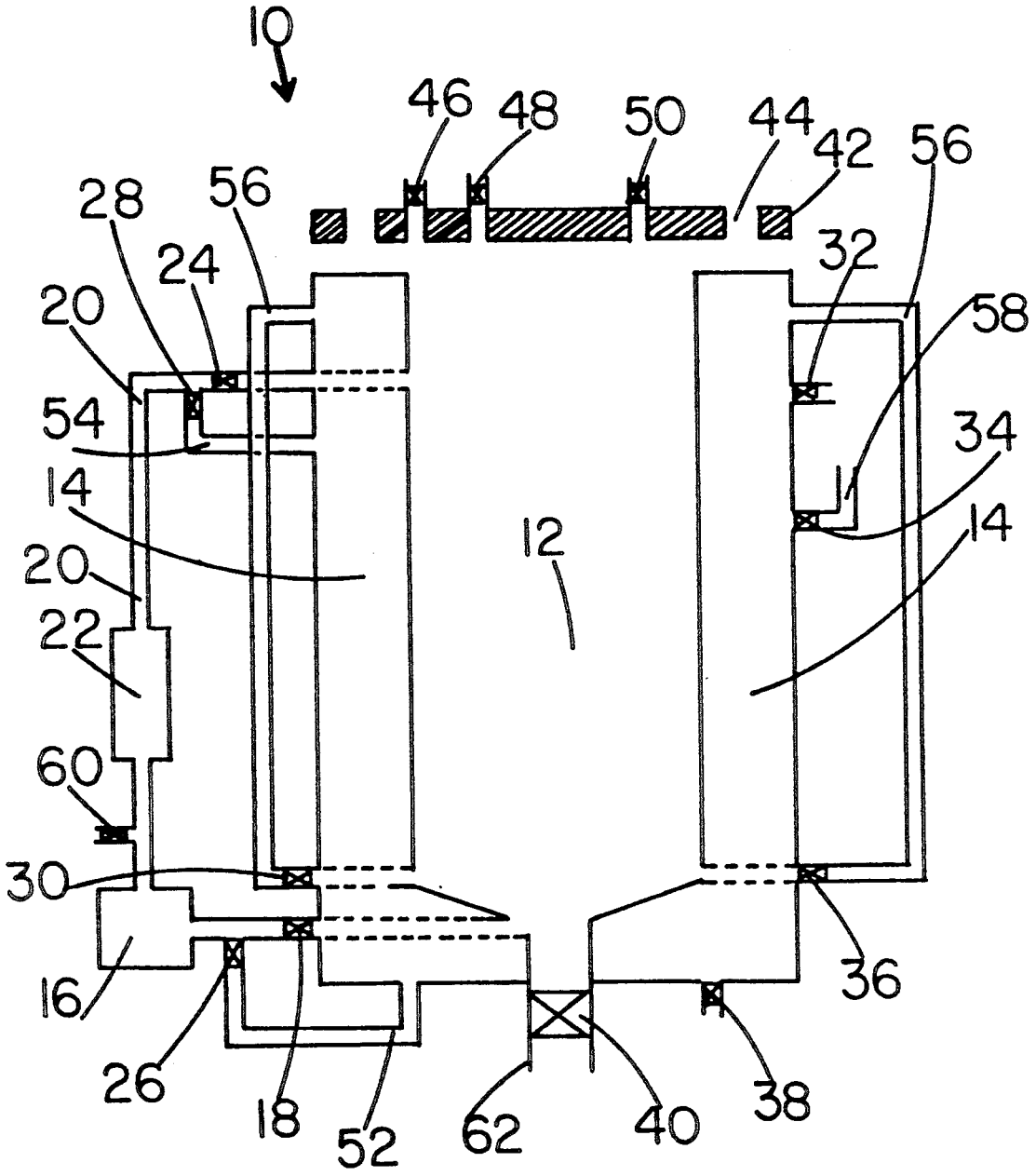

The invention, as exemplified by a preferred embodiment, is described with reference to the drawings in which:

FIG. 1 is a perspective view of an embodiment of an apparatus of the invention; and FIG. 2 is a sectional view of the apparatus shown in FIG. 1.

Referring to drawings, the embodiment of the invention shown, an apparatus 10 comprises two concentric compartments: an inner compartment 12 where the chemical treatment takes place and an outer compartment 14 where hot water or steam is generated by means of a heat exchanger 22. The top and the bottom of the outer compartment 14 are completely sealed and connected to the inner compartment 12.

The inner compartment 12 is connected to, near the bottom, a circulation pump 16 which circulates the chemical solution, via a valve 18, through a circulation conduit 20 which leads the liquid throught a heat exchanger 22, and to the upper part of the inner compartment 12, via a valve 24. In this case, the outer compartment 14 is emptied and the valves 26, 28, 30, 32, 34, 36, 38, 40 and 60 are closed and the valves 18 and 24 are opened. In pressurized conditions, the cover 42 is fixed onto the apparatus by means of bolts and nuts through the holes 44, and the valves 46, 48 and 50 are closed.

The outer compartment 14 is connected by a conduit 52 leading from its bottom to the circulation conduit 20 passing through the pump 16 and the heat exchanger 22 and to the upper part of said compartment 14 via a valve 28 and a conduit 54. This design allows the water in the outer compartment 14 to be pumped 16 and heated 22 and circulated back to the same compartment in the process of heat or steam generation.

The outer 14 and the inner 12 compartments are interconnected by means of two steam conduits 56, one opposite the other, permitting the steam generated in the outer compartment 14 to enter the lower part of the inner compartment 12, via the valves 30 and 36. In order to perform a vapour phase treatment of lignocellulosic materials, the valves 18, 24, 32, 34, 38, 40, 46, 48, 50, 60 and the cover 42 are closed, while the valves 26, 28, 30 and 36 are opened.

On one side of the outer compartment 14, a water inlet conduit 58 is located on the upper part of the outer compartment 14. The position of said inlet conduit 58 should be higher than the water level required in the outer compartment 14. The inlet conduit 58 is controlled by an inlet valve 34. A breath valve 32 is located in a position slightly higher than the inlet conduit 58, to facilitate the filling of the outer compartment 14.

The cover 42 for the apparatus 10 is equipped with a cold-water spray valve 46 for rapid cooling of the inner compartment 12, a pressure release valve 48 for depressurizing the inner compartment 12, and a pressure relief valve or safty valve 50.

A drain valve 38, located under the bottom the outer compartment 14, allows the water to be drained out.

A sample collecting valve 60 is located on the circulation conduit 20 between the pump 16 and the heat exchanger 22.

The bottom of the inner compartment 12 has a concave surface which facilates the discharge of the treated material through a large outlet 62, the opening of which is controlled by a pneumatic quick-discharge valve 40.

The apparatus is preferably made of stainless steel, and equipped with a temperature controller and a pressure regulator and readout.

A feature of the apparatus of this invention is its ability to perform either liquid phase or vapour phase treatment of lignocellulosic materials. To carry out liquid phase treatment, the treatment liquor in the inner compartment is circulated by a pump and heated by a heat exchanger. To perform vapour phase treatment, the water in the outer compartment is circulated by a pump and heated by a heat exchanger.

Another feature of the apparatus of this invention is its ability to carry out vacuum or pressure impregnation of lignocellulosic materials with chemicals in the inner compartments. Vacuum or compressed gas can be applied through the cold spray valve located in the cover.

An optional feature of the apparatus of this invention is that an electrical stirrer can be installed to execut mixing of chemicals with the lignocellulosic materials in the inner compartment, either under atmospheric or pressurized conditions.

Although only a single embodiment of the present invention has been described and illustrated, the present invention is not limited to the features of this embodiment, but includes all variations and modifications within the scope of the claims.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claims.

What is claimed is:

1. An apparatus for chemically treating lignocellulosic materials comprising in combination a main body composed of interconnected, concentric, inner and outer compartments and a top and bottom cover; a heat exchanger; a pump for circulating water or treatment liquor from said compartments to said heat exchanger; a quick-discharge valve located at the bottom of the inner compartment for discharging treated material; conduits connecting the inner and outer compartments, the compartments and the pump, the pump and the heat exchanger, and the heat exchanger and the compartments; valves installed at different locations in said conduits, said valves capable of regulating the flow of said water or said treatment liquor for a particular treatment process of said lignocellulosic materials; means for collecting a sample of the treatment liquor during the treatment process; means for introducing water into the outer compartment; means for introducing treatment liquor into the inner compartment; means for introducing lignocellulosic materials into the inner compartment; and means for draining said outer compartment, said pump, and said heat exchanger.

2. The apparatus combination of claim 1, wherein the outer compartment is adapted to contain water which circulates through said pump and is heated by said heat exchanger to produce steam which is used in the inner compartment; the inner compartment is adapted to hold the lignocellulosic material and the treatment liquor, so that said lignocellulosic material and said treatment liquor can be heated by the steam generated in said outer compartment, or by heating the treatment liquor by said heat exchanger; and said conduits which connect said outer and inner compartments extend from the upper portion of said outer compartment into the lower portion of said inner compartment, permitting the flow of steam from said outer compartment to said inner compartment.

3. The apparatus combination of claim 1 wherein said top cover of said main body has a cold water spray valve, a pressure release valve, and a pressure safety valve; and the center region of said bottom cover of said main body has a full unobstructed outlet to permit the discharge of material by blowing through said quick-discharge valve.

4. The apparatus combination of claim 3 wherein said pressure release valve has means to permit the application of compressed air or gas to pressurize said inner compartment, and to also permit the application of suction to create a vacuum pressure in said inner compartment.

5. The apparatus combination of claim 1 wherein said pump is connected at one end by conduit means to the bottom of said outer compartment and to the bottom of said inner compartment, and said pump is connected at the other end to said heat exchanger, and said pump and conduit means are capable of circulating the water in said outer compartment to said heat exchanger and back to said outer compartment, and said pump and conduit means also capable of circulating the treatment liquor in said inner compartment to said heat exchanger and back to said inner compartment.

6. The apparatus combination of claim 1 wherein said heat exchanger is connected at one end by conduit means to said pump, and is connected to the upper portion of said outer and inner compartments, said heat exchanger being capable of heating said water or said treatment liquor up to 200° C. and generating steam at a temperature up to 200° C.

7. The apparatus combination of claim 1 wherein said sample collecting means is located in said circulation conduit between said pump and said heat exchanger, said sample collecting means being capable of collecting treatment liquor samples during the treatment process for analyzing.

* * * * *